US008839879B2

(12) United States Patent
Elger et al.

(10) Patent No.: US 8,839,879 B2
(45) Date of Patent: Sep. 23, 2014

(54) ANVIL ASSEMBLY FOR A POWER TOOL

(75) Inventors: William A. Elger, West Bend, WI (US); Matthew T. Bertsch, New Berlin, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 403 days.

(21) Appl. No.: 12/991,165

(22) PCT Filed: May 7, 2009

(86) PCT No.: PCT/US2009/043159

§ 371 (c)(1),
(2), (4) Date: Nov. 5, 2010

(87) PCT Pub. No.: WO2009/137690

PCT Pub. Date: Nov. 12, 2009

(65) Prior Publication Data

US 2011/0056714 A1 Mar. 10, 2011

Related U.S. Application Data

(60) Provisional application No. 61/051,119, filed on May 7, 2008.

(51) Int. Cl.

| | |
|---|---|
| ***B25D 17/06*** | (2006.01) |
| ***B25B 21/02*** | (2006.01) |
| ***B25D 17/00*** | (2006.01) |
| ***B25B 23/00*** | (2006.01) |

(52) U.S. Cl.

CPC ..... *B25B 21/02* (2013.01); *B25D 17/005* (2013.01); *B25D 17/06* (2013.01); *B25B 23/0035* (2013.01)

USPC ..... 173/93; 173/29; 173/93.5; 173/128; 173/132; 279/19.1; 279/19.3

(58) Field of Classification Search

CPC .. B25B 21/02; B25B 21/026; B25B 23/0035; B25B 23/0007; B25D 17/005; B25D 17/06

USPC ..... 173/93, 93.5, 93.6, 29, 132; 279/19.1, 279/19.3; 81/177.85; 403/225, 365

See application file for complete search history.

(56) References Cited

U.S. PATENT DOCUMENTS 2,881,884 A 4/1959 Amtsberg
3,533,479 A * 10/1970 Albertson et al. ..... 173/93.5

(Continued)

FOREIGN PATENT DOCUMENTS

CN 2700061 5/2005

OTHER PUBLICATIONS

PCT/US2009/043159 International Search Report and Written Opinion, Jun. 26, 2009.

(Continued)

*Primary Examiner* — Scott A. Smith

(74) *Attorney, Agent, or Firm* — Michael Best & Friedrich LLP

(57) ABSTRACT

An anvil assembly for a tool includes an anvil having a body with an outer periphery and a head formed on a distal end of the body. The anvil assembly also includes a sleeve surrounding at least a portion of the outer periphery of the body. The sleeve has a distal end against which a tool element is abutted when the tool element is coupled to the head.

20 Claims, 9 Drawing Sheets

(56) References Cited

U.S. PATENT DOCUMENTS

| | | | | |
|---|---|---|---|---|
| 3,744,350 | A | 7/1973 | Raff | |
| 3,952,814 | A | 4/1976 | Gelfand et al. | |
| 4,557,337 | A * | 12/1985 | Shibata | 173/93.5 |
| 5,038,869 | A | 8/1991 | Olson | |
| 5,095,784 | A | 3/1992 | Garver | |
| 5,485,769 | A * | 1/1996 | Olson et al. | 81/177.85 |
| 6,038,946 | A * | 3/2000 | Jackson et al. | 81/177.2 |
| 6,070,674 | A * | 6/2000 | Williamson et al. | 173/1 |
| 6,938,526 | B2 | 9/2005 | Milbourne et al. | |
| 7,036,406 | B2 | 5/2006 | Milbourne et al. | |
| 7,083,003 | B1 | 8/2006 | Pusateri et al. | |
| 7,207,393 | B2 | 4/2007 | Clark, Jr. | |
| 7,249,638 | B2 * | 7/2007 | Bodine et al. | 173/93 |
| 7,980,321 | B2 * | 7/2011 | Happ | 173/128 |
| 8,074,732 | B2 * | 12/2011 | Lehnert et al. | 173/93 |
| 2005/0022637 | A1 | 2/2005 | Milbourne et al. | |
| 2006/0118316 | A1 | 6/2006 | Clark, Jr. et al. | |
| 2006/0151188 | A1 | 7/2006 | Bodine et al. | |
| 2007/0266545 | A1 | 11/2007 | Bodine et al. | |
| 2008/0087448 | A1 | 4/2008 | Happ | |

OTHER PUBLICATIONS

Dewalt Parts List for DC800KL Type 1; Copyright 2005; pp. 1-3.

Milwaukee Service Parts List for Impact Wrench Model 9070-20; Jul. 2002, pp. 1-2.

Milwaukee Operator's Manual for Impact Wrench Model Nos. 9070-20, 9071-20, 9072-20, 9072-22, 9075-20, 9092-20, 9096-20; May 2007; pp. 1-36.

Milwaukee Service Parts List for Impact Wrench Model 9079-20; Jul. 2003; pp. 1.

Milwaukee Operator's Manual for Impact Wrench Model Nos. 9078-20, 9079-20, 9098-23, 9099-20; Sep. 2007; pp. 1-28.

* cited by examiner

ANVIL ASSEMBLY FOR A POWER TOOL

CROSS-REFERENCE TO RELATED APPLICATIONS

This application claims priority to U.S. Provisional Patent Application Ser. No. 61/051,119 filed on May 7, 2008, the entire contents of which is incorporated herein by reference.

FIELD OF THE INVENTION

The present invention relates to tools, and more particularly to power tools.

BACKGROUND OF THE INVENTION

Anvil assemblies are typically employed in power tools (e.g., electrically-operated power tools, pneumatic power tools, etc.) to transfer torque from a motor to a tool element to perform work on a workpiece. Particularly, impact wrenches utilize anvil assemblies to transfer a striking rotational force, or intermittent applications of torque, to the tool element and workpiece. As such, impact wrenches are typically used to loosen or remove stuck fasteners (e.g., an automobile lug nut on an axle stud) that are otherwise not removable or very difficult to remove using hand tools.

Depending upon the size and configuration of the impact wrench, a relatively large amount of torque may be transferred through the anvil to the tool element and workpiece. Anvils typically include a square head configured to receive the tool element, and a shoulder against which the tool element is abutted. The shoulder is typically formed by a continuous or non-continuous surface extending substantially perpendicular to one or more flats on the square head. As such, a fillet having a relatively small radius is often employed to transition the respective flats on the square head to the shoulder on the anvil. Such small fillet radii, as a result of the high torsional loads that may be carried through the anvil, often yield an area of high stress at the base of the head.

SUMMARY OF THE INVENTION

The invention provides, in one aspect, an anvil assembly for a tool. The tool includes a tool element for working on a workpiece. The anvil assembly includes an anvil having a body with an outer periphery and a head formed on a distal end of the body. The anvil assembly also includes a sleeve surrounding at least a portion of the outer periphery of the body. The sleeve has a distal end against which the tool element is abutted when the tool element is coupled to the head.

The invention provides, in another aspect, a power tool operable with a tool element for working on a workpiece. The power tool includes a housing, a motor supported by the housing, and an anvil coupled to the motor to receive torque produced by the motor. The anvil includes a body having an outer periphery and a head formed on a distal end of the body. The power tool also includes a sleeve surrounding at least a portion of the outer periphery of the body. The sleeve has a distal end against which the tool element is abutted when the tool element is coupled to the head.

The invention provides, in yet another aspect, a power tool operable with a tool element for working on a workpiece. The power tool includes a housing, a motor supported by the housing, and an anvil coupled to the motor to receive torque produced by the motor. The anvil includes a body having an outer periphery, a head formed on a distal end of the body, and a plurality of radially-extending lugs extending from the body. The power tool also includes a sleeve surrounding at least a portion of the outer periphery of the body. The sleeve includes a distal end against which the tool element is abutted when the tool element is coupled to the head, and a flange spaced from the distal end and abutted against the radially-extending lugs.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
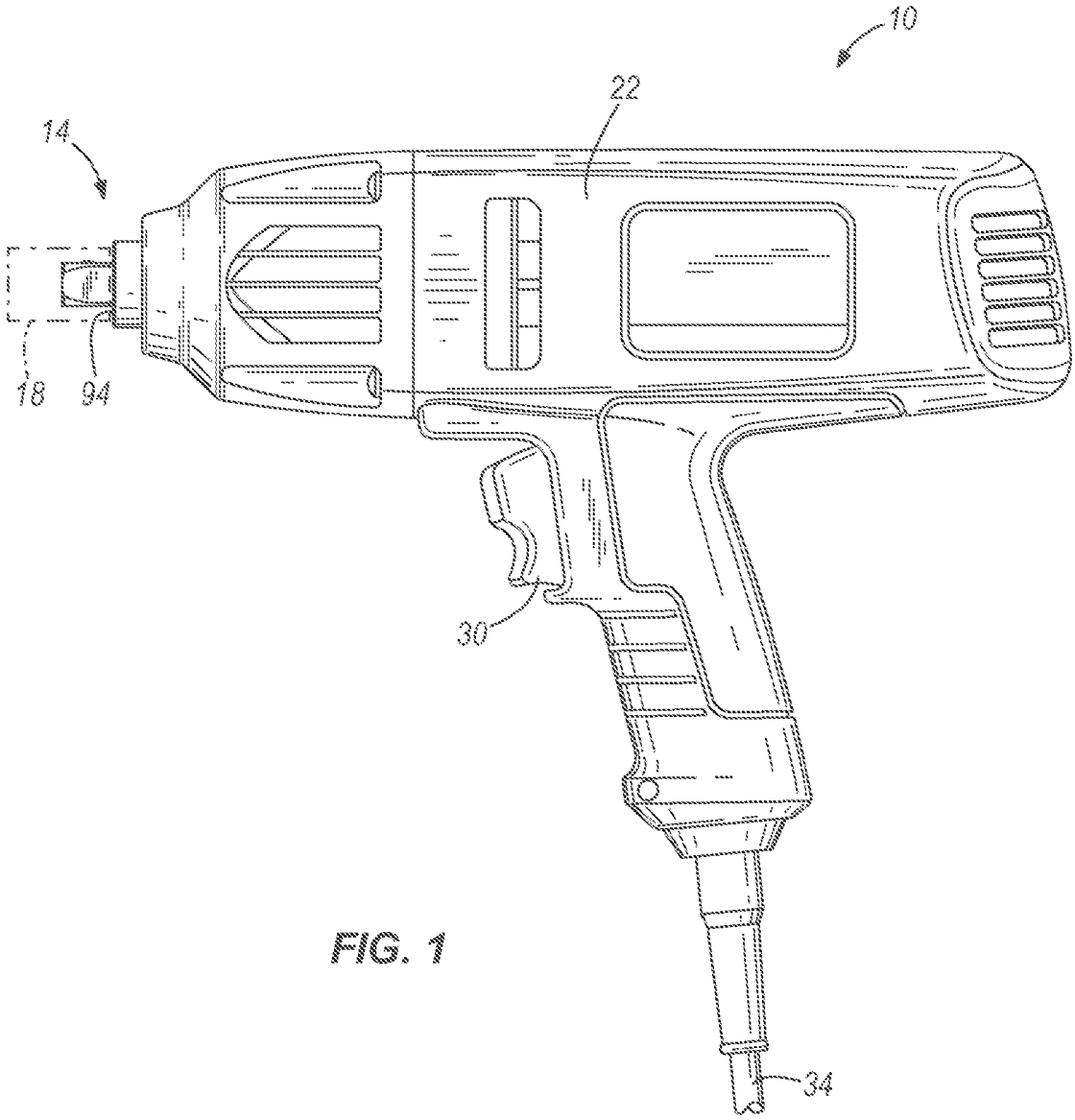
FIG. 1 is a side view of an impact wrench incorporating an anvil assembly according to one construction of the invention.
Figure 2:
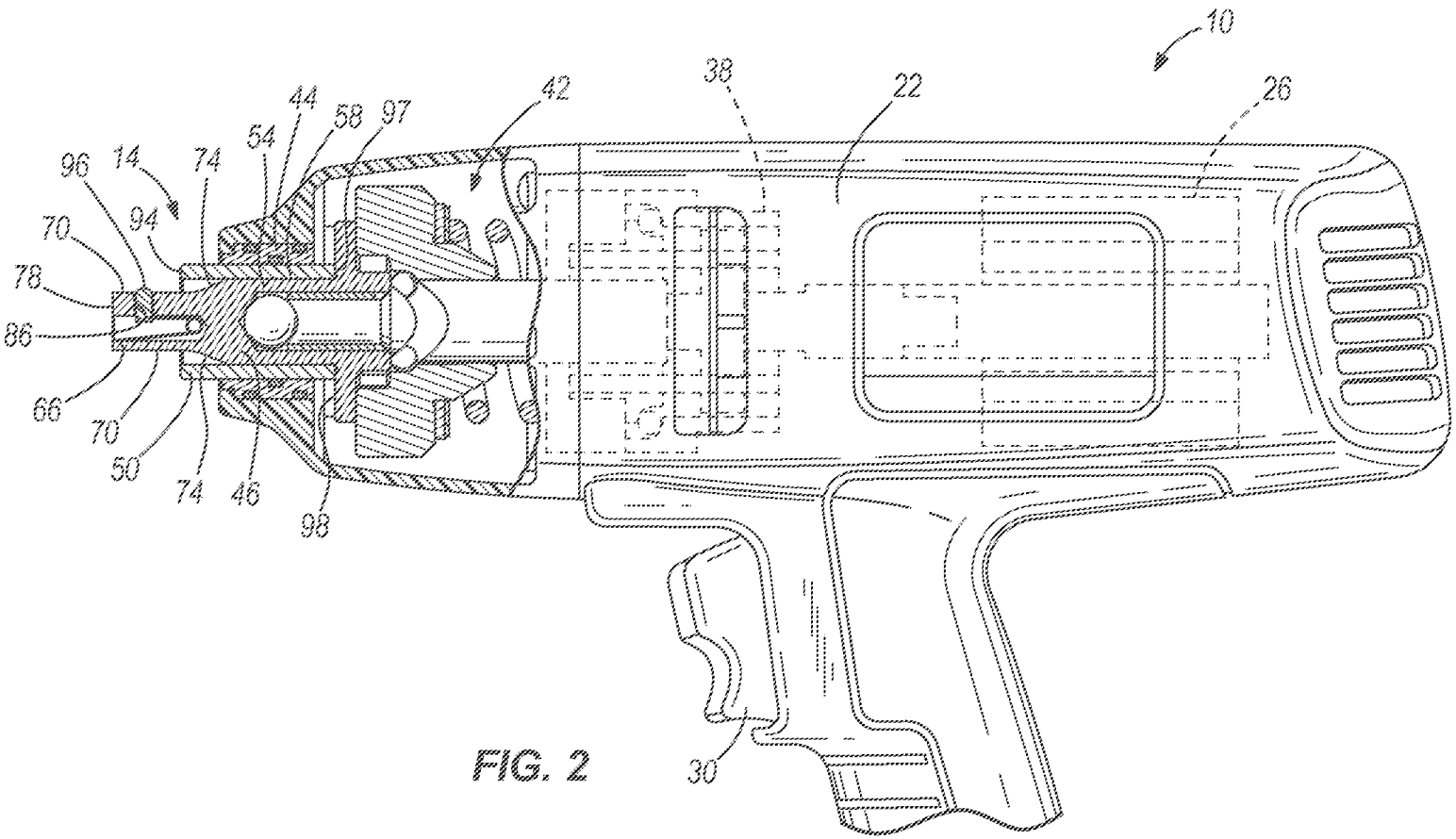
FIG. 2 is a partial cutaway view of the impact wrench of FIG. 1, illustrating the anvil assembly in cross-section.

FIG. 1 illustrates an impact wrench 10 including an anvil assembly 14 and a tool element 18 coupled to the anvil assembly 14. Although the tool element 18 is schematically illustrated, the tool element 18 may include a socket configured to engage the head of a fastener (e.g., a bolt). Alternatively, the tool element 18 may include any of a number of different configurations (e.g., an auger or a drill bit) to perform work on a workpiece. With reference to FIGS. 1 and 2, the impact wrench 10 includes a housing 22 and a reversible electric motor 26 (FIG. 2) coupled to the anvil assembly 14 to provide torque to the anvil assembly 14 and the tool element 18. The impact wrench 10 also includes a switch (e.g., trigger switch 30) supported by the housing 22 and a power cord 34 extending from the housing 22 for electrically connecting the switch 30 and the motor 26 to a source of AC power. Alternatively, the impact wrench 10 may include a battery, and the motor 26 may be configured to operate on DC power provided by the battery. As a further alternative, the impact wrench 10 may be configured to operate using a different power source (e.g., a pneumatic or hydraulic power source, etc.) besides electricity.

With reference to FIG. 2, the impact wrench 10 also includes a gear assembly 38 coupled to an output of the motor 26 and a drive assembly 42 coupled to an output of the gear assembly 38. The gear assembly 38 may be configured in any of a number of different ways to provide a speed reduction between the output of the motor 26 and an input of the drive assembly 42. The drive assembly 42, of which the anvil assembly 14 may be considered a component, is configured to convert the constant rotational force or torque provided by the gear assembly 38 to a striking rotational force or intermittent applications of torque to the tool element 18. U.S. Pat. No. 6,733,414, the entire contents of which is incorporated herein by reference, discloses in detail example configurations of the gear assembly 38 and portions of the drive assembly 42 between the anvil assembly 14 and the gear assembly 38. The impact wrench 10 further includes a bushing 44 secured to the front of the housing 22 to rotatably support the anvil assembly 14. Alternatively, a bearing (e.g., a roller or ball bearing) may be substituted for the bushing 44.

Figure 3:
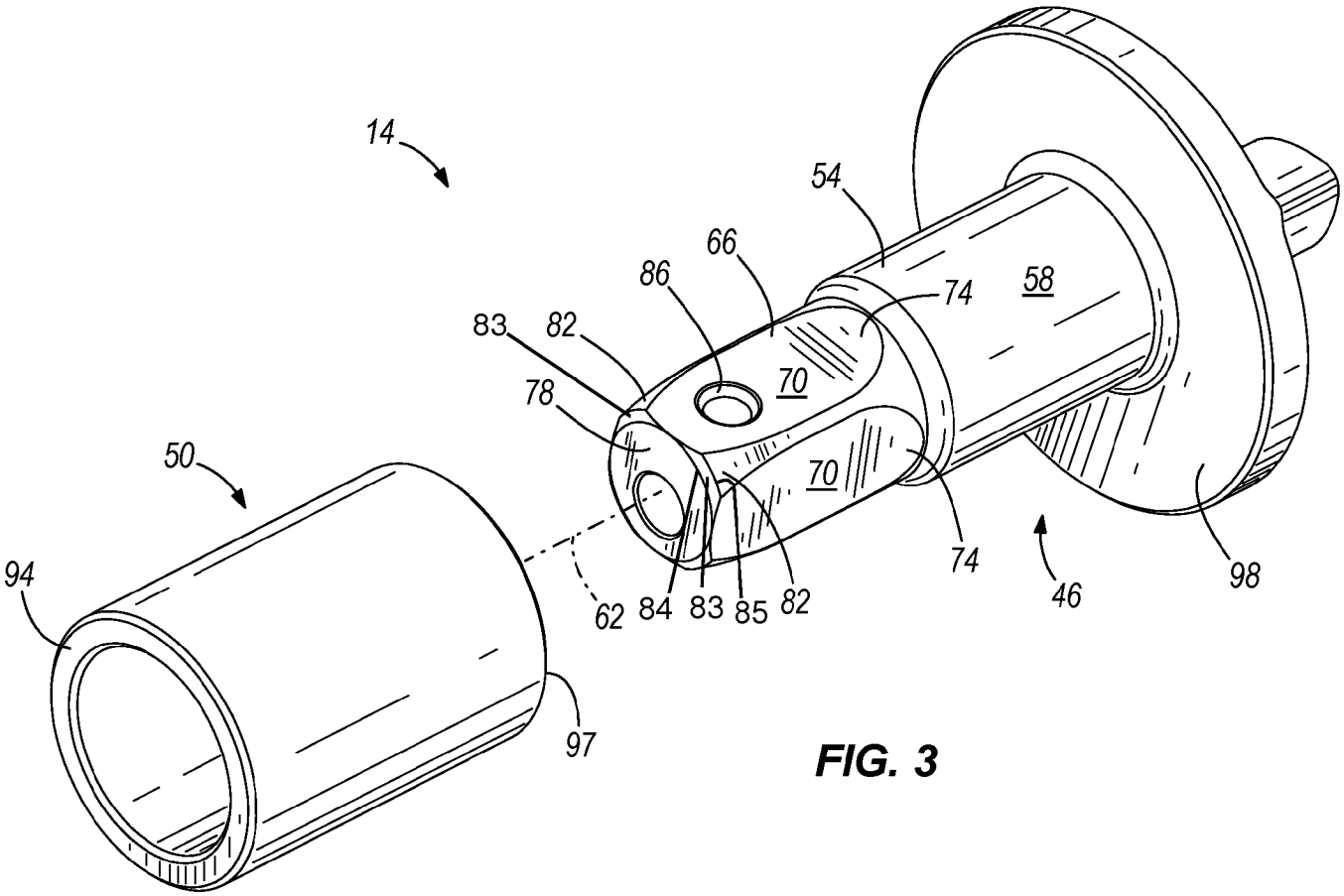
FIG. 3 is an exploded perspective view of the anvil assembly of FIG. 2.
Figure 5:
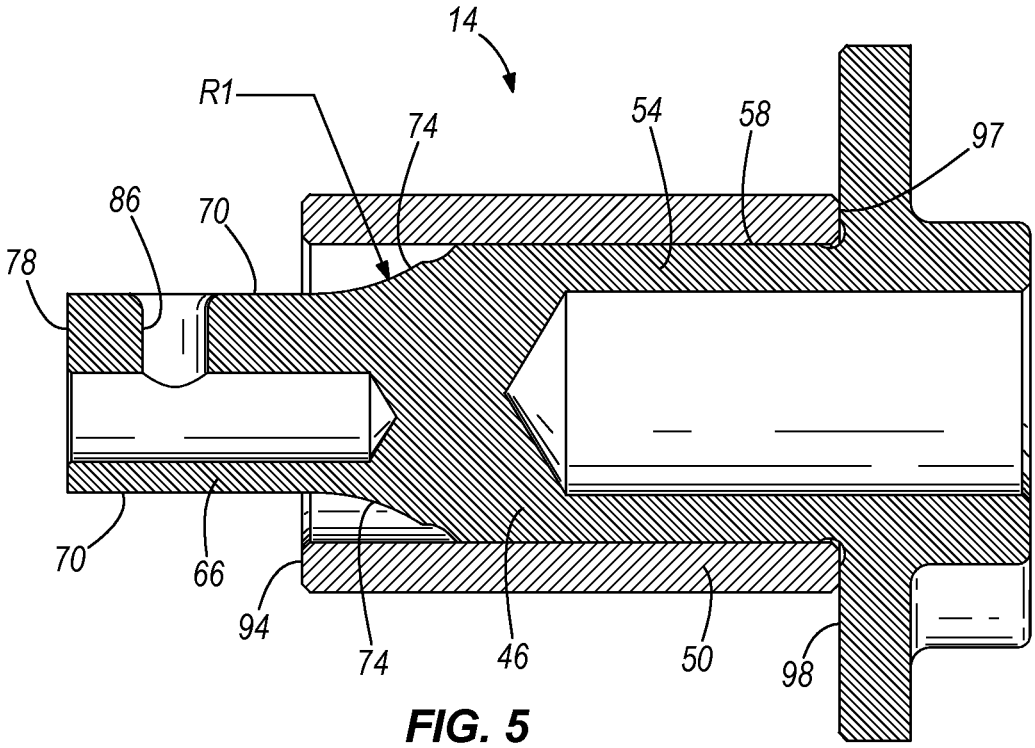
FIG. 5 is a cross-sectional view of the anvil assembly of FIG. 3, taken along line 5-5 in FIG. 4.

With reference to FIGS. 2 and 3, the anvil assembly 14 includes an anvil 46 and a sleeve 50 supporting the anvil 46 for rotation in the housing 22. The anvil 46 includes a body 54 having a cylindrical outer periphery 58 defining a longitudinal axis 62, and a head 66 formed on a distal end of the body 54. As shown in FIG. 5, the sleeve 50 surrounds the body 54, and in the illustrated construction of the anvil assembly 14, the outer diameter of the cylindrical outer periphery 58 of the body 54 and the inner diameter of the sleeve 50 are sized to provide an interference fit between the sleeve 50 and the body 54. In another construction, different structure (e.g., a key and keyway arrangement) may be utilized to interconnect the sleeve 50 and the body 54 so that the sleeve 50 co-rotates with the body 54 during operation of the impact wrench 10. Further, any of a number of different processes (e.g., welding, brazing, using adhesives, etc.) may also be utilized in addition to or in place of the interference fit between the sleeve 50 and the body 54.

Figure 4:
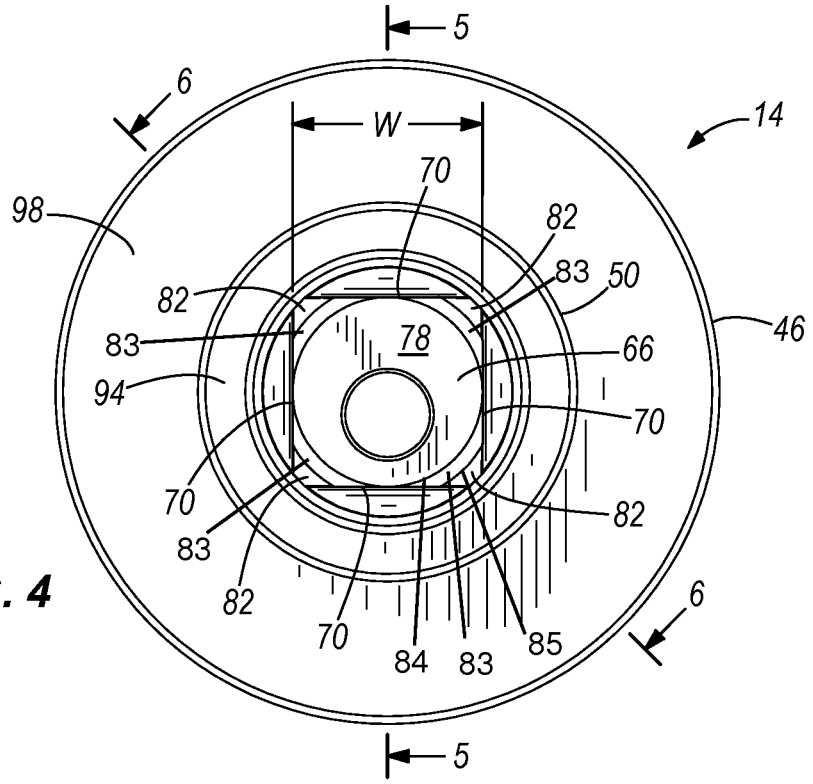
FIG. 4 is a front view of the anvil assembly of FIG. 3.

With reference to FIGS. 3 and 4, the head 66 includes a generally square cross-sectional shape as viewed in a direction along the longitudinal axis 62 (FIG. 4), and includes a plurality of substantially flat or planar surfaces 70 that, taken together, form the generally square cross-sectional shape of the head 66. In the illustrated construction of the anvil assembly 14, the head 66 includes four substantially planar surfaces 70, with adjacent substantially planar surfaces 70 oriented substantially normal to each other. Alternatively, the cross-sectional shape of the head 66 may be configured in any of a number of different ways to accept or receive tool elements 18 having corresponding-shaped apertures or recesses to receive the head 66.

With reference to FIGS. 3 and 5, the anvil 46 also includes a plurality of fillets, or curved or substantially arcuate surfaces 74, each of which at least partially transitions a respective substantially planar surface 70 of the head 66 to the cylindrical outer periphery 58 of the body 54. As shown in FIG. 5, each of the arcuate surfaces 74 has a relatively large radius R1 to reduce the stress applied to the anvil 46 at the base of the head 66 during operation of the impact wrench 10. Preferably, the radius R1 of the arcuate surfaces 74 is sized as large as the particular design of the anvil 46 permits. For example, the radius R1 of the arcuate surfaces 74 may be at least about 0.5 inches. Alternatively, the radius R1 of the arcuate surfaces 74 may be at least about 0.375 inches. As a further alternative, the radius R1 of the arcuate surfaces 74 may be at least about 0.25 inches. The radius R1 of the arcuate surfaces 74 may alternatively correlate with the cross-sectional dimensions of the head 66 (i.e., the width of the planar surfaces 70). For example, the radius R1 of the arcuate surfaces 74 may correlate to the width W (FIG. 4) of the head 66, as measured in a direction transverse to the longitudinal axis 62, by a constant "X." As such, an anvil 46 having a head 66 with a nominal dimension of 0.5 inches for the width W (i.e., a half-inch drive head 66) would include arcuate surfaces 74 having a radius R1 of about 0.5X inches. In the illustrated construction of the anvil assembly 14, the radius R1 of the arcuate surfaces 74 is about equal to (i.e., 1-time) the width W of the head 66. Therefore, for a half-inch drive head 66, the radius R1 of the arcuate surfaces 74 is equal to about 0.5 inches. Likewise, for a three-eighths drive head 66, the radius of the arcuate surface 74 would be equal to about 0.375 inches, and for a quarter-inch drive head 66, the radius of the arcuate surface 74 would be equal to about 0.25 inches.

Figure 6:
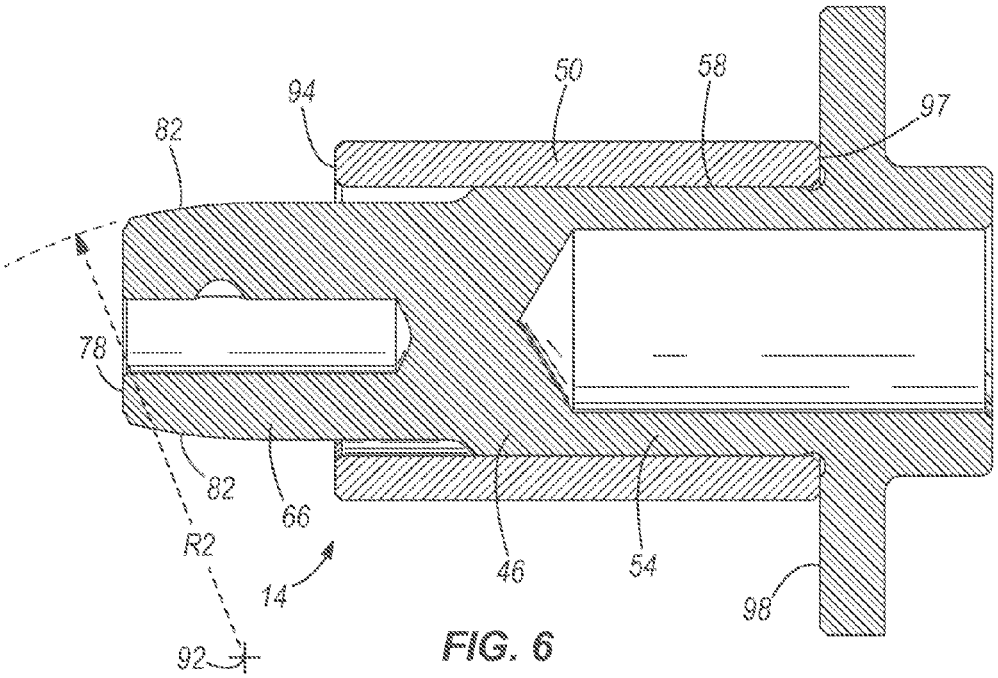
FIG. 6 is a cross-sectional view of the anvil assembly of FIG. 3, taken along line 6-6 in FIG. 4.

With reference to FIGS. 3 and 6, the anvil 46 also includes a substantially planar end surface 78 formed on the distal end of the head 66, and a corner 82 disposed at an intersection of each pair of adjacent substantially planar surfaces 70. The corners 82 at least partially transition the substantially planar surfaces 70 to the substantially planar end surface 78 of the head 66. The anvil 46 also includes a chamfer 83 having a first edge 84 shared with the substantially planar end surface 78 and a second edge 85 shared with the corners 82. By providing the corners 82 on the head 66, stress applied near the distal end of the head 66 is more efficiently transferred away from the distal end of the head 66, and toward the base of the head 66 and the substantially arcuate surfaces 74 of the head 66. Particularly, by providing the corners 82 on the head 66, torsional loading near the planar end surface 78 is reduced. As a result, stress surrounding a detent aperture 86 in the head 66 (FIGS. 2 and 3) is reduced and efficiently transferred toward the base of the head 66 and the substantially arcuate surfaces 74.

With reference to FIG. 6, each of the corners 82 defines a radius R2 having a center (one of which is shown with reference numeral "92" in FIG. 6) located rearward of the detent aperture 86 (FIG. 5). For example, the radius R2 of each of the corners 82 may be at least about 1 inch. Alternatively, the radius R2 of each of the corners 82 may be at least about 0.75 inches. As a further alternative, the radius R2 of each of the corners 82 may be at least about 0.5 inches. Like the radius R1, the radius R2 of the corners 82 may alternatively correlate to the width W of the head 66 by a constant "Y." For an anvil 46 having a head 66 with a nominal dimension of 0.5 inches for the width W (i.e., a half-inch drive head 66), the corners 82 would define a radius R2 of about 0.5Y inches. For example, the radius R2 of the corners 82 may be about 2 times the width W of the head 66 (i.e., about 1 inch for a half-inch drive head 66, about 0.75 inches for a three-eighths drive head 66, and about 0.5 inches for a quarter-inch drive head 66; where Y=2). Alternatively, the radius R2 may be greater or less than 2 times the width W of the head 66. As a further alternative, the radius R2 may be sized as large as the particular design of the head 66 permits.

Figure 6A:
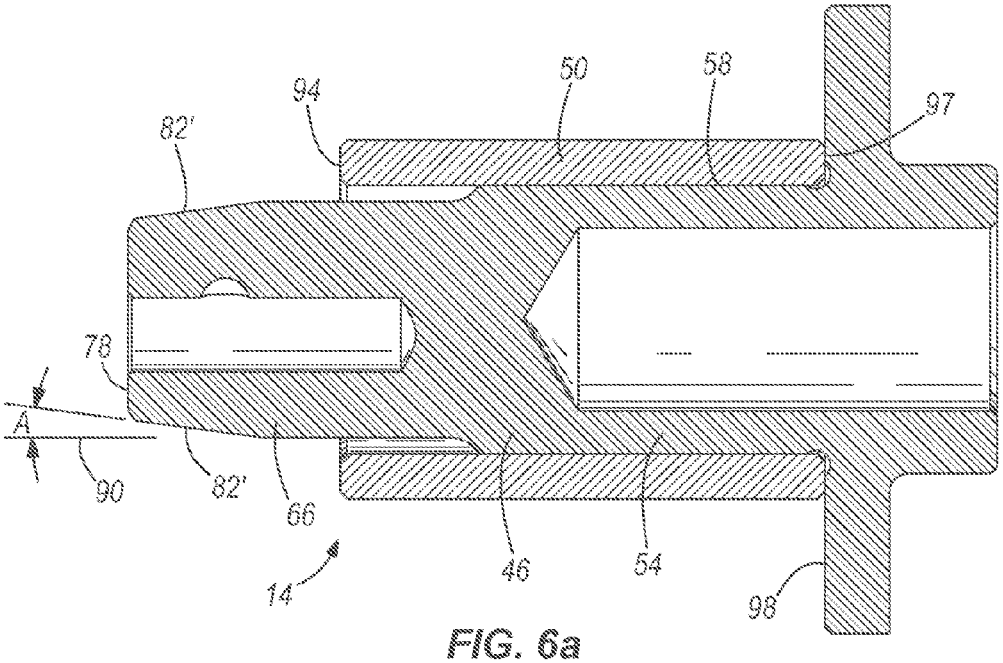
FIG. 6*a* is a cross-sectional view, similar to that of FIG. 6, of the anvil assembly of FIG. 3 having a differently configured head.

With reference to FIG. 6*a*, the anvil assembly 14 may alternatively include corners (denoted by reference numerals 82') that are tapered rather than defined by a radius. Each of the corners 82' forms an angle A with a reference plane 90 oriented substantially normal to the planar end surface 78 of the head 66. For example, the angle A may be about 11 degrees. However, the angle A may be greater than or less than about 11 degrees. Generally, the greater the value of the angle A, the more efficiently stress applied near the distal end of the head 66 is transferred toward the base of the head 66.

With reference to FIGS. 1 and 2, the sleeve 50 includes a distal end 94 against which the tool element 18 is abutted when coupled to the head 66. As shown in FIGS. 2 and 5, the distal end 94 of the sleeve 50 extends past an interface between each of the respective substantially planar surfaces 70 and the respective substantially arcuate surfaces 74, such that the sleeve 50 substantially overlies each of the surfaces 74. As such, the extent to which the tool element 18 is engageable with the head 66 is limited by the position of the distal end 94 of the sleeve 50 relative to the head 66, thereby preventing the tool element 18 from engaging the substantially arcuate surfaces 74. The distal end 94 of the sleeve 50 also accurately locates the tool element 18 relative to a detent pin 96 located in the detent aperture 86 (FIG. 2), such that the tool element 18 is securely attached to the anvil 46 upon abutting the distal end 94 of the sleeve 50.

With reference to FIG. 5, the sleeve 50 includes a second distal end 97 opposite the distal end 94 against which the tool element 18 is abutted. The anvil 46 includes a relatively large, continuous flange 98 (FIGS. 2 and 5) against which the second distal end 97 of the sleeve is abutted. By configuring the anvil assembly 14 as two separate and distinct pieces or components (i.e., the anvil 46 and the sleeve 50), the function of providing a shoulder to abut the tool element 18 is shifted to the sleeve 50, which bears against the flange 98 formed on the anvil 46. Consequently, the radii of the respective fillets or arcuate surfaces 74 may be increased to reduce the stress near the base of the head 66 during operation of the impact wrench 10. Because the fillets or arcuate surfaces 74 need not transition the respective substantially planar surfaces 70 of the head 66 to one or more surfaces that are substantially normal to the longitudinal axis 62 of the anvil 46 to provide a shoulder against which the tool element 18 may be abutted, the radii of the respective fillets or arcuate surfaces 74 on the anvil 46 may be increased as large as the design of the anvil 46 allows.

Figure 7:
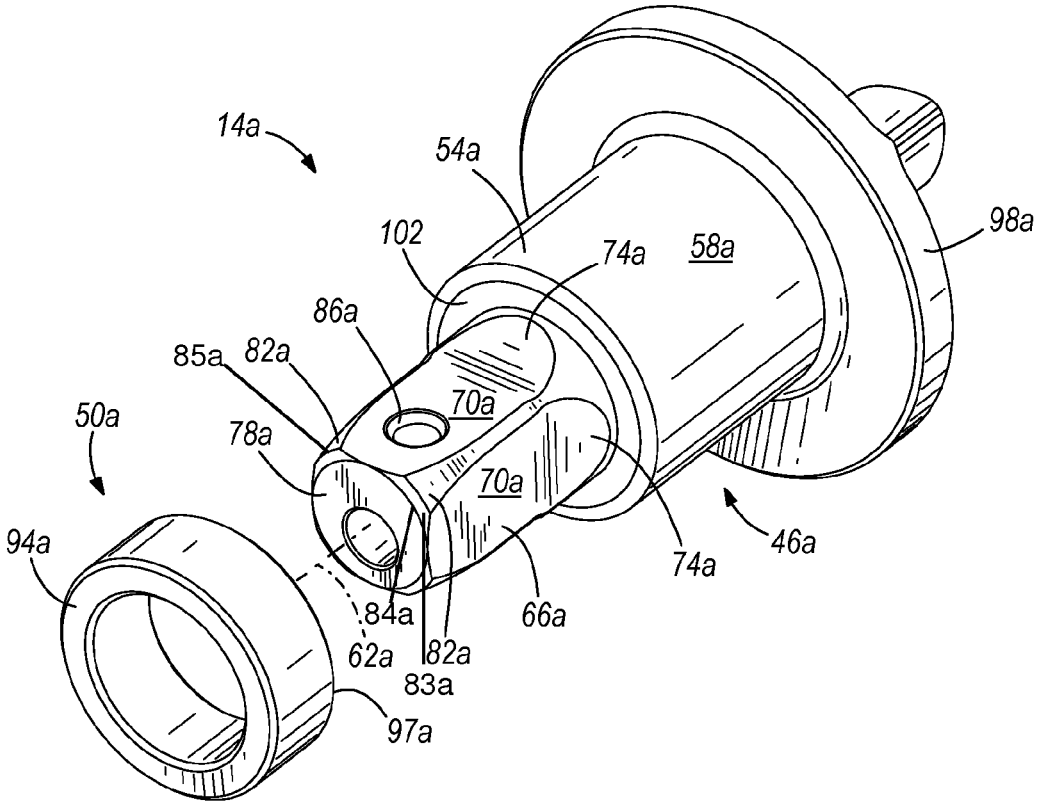
FIG. 7 is an exploded perspective view of an anvil assembly according to another construction of the invention.

With reference to FIG. 7, a second construction of the anvil assembly 14*a* is shown, with like components labeled with like reference numerals including the letter "a." The anvil assembly 14*a* is substantially similar to the anvil assembly 14 of FIGS. 1-6, however, the sleeve 50*a* of the anvil assembly 14*a* is shorter than the sleeve 50 of the anvil assembly 14 of FIGS. 1-6. Rather than bearing against the flange 98*a* on the anvil 46, the second end 97 of the sleeve 50*a* bears against an end surface 102 of the cylindrical outer periphery 58*a* of the body 54*a*.

Figure 8:
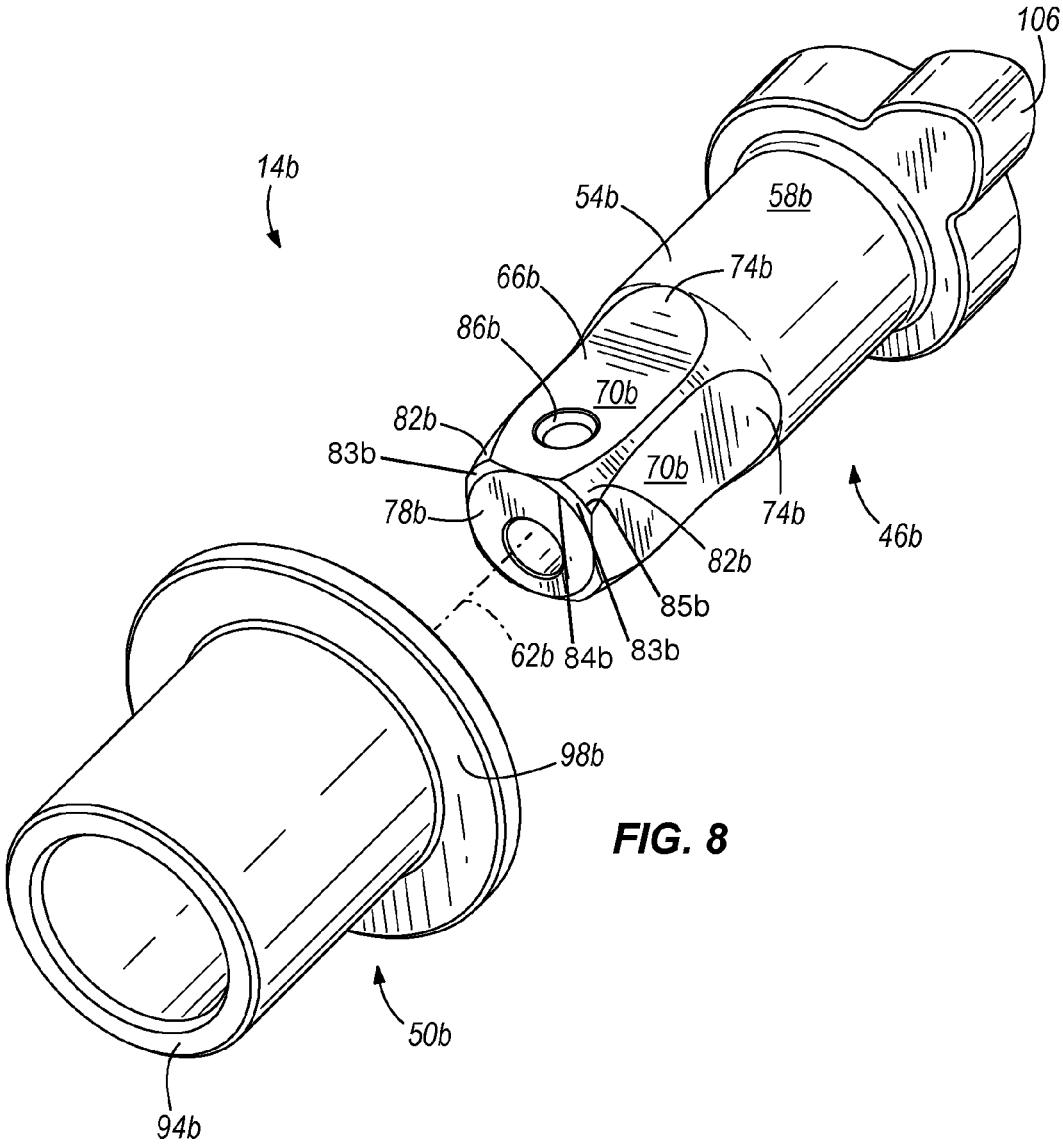
FIG. 8 is an exploded, front perspective view of an anvil assembly according to yet another construction of the invention.
Figure 9:
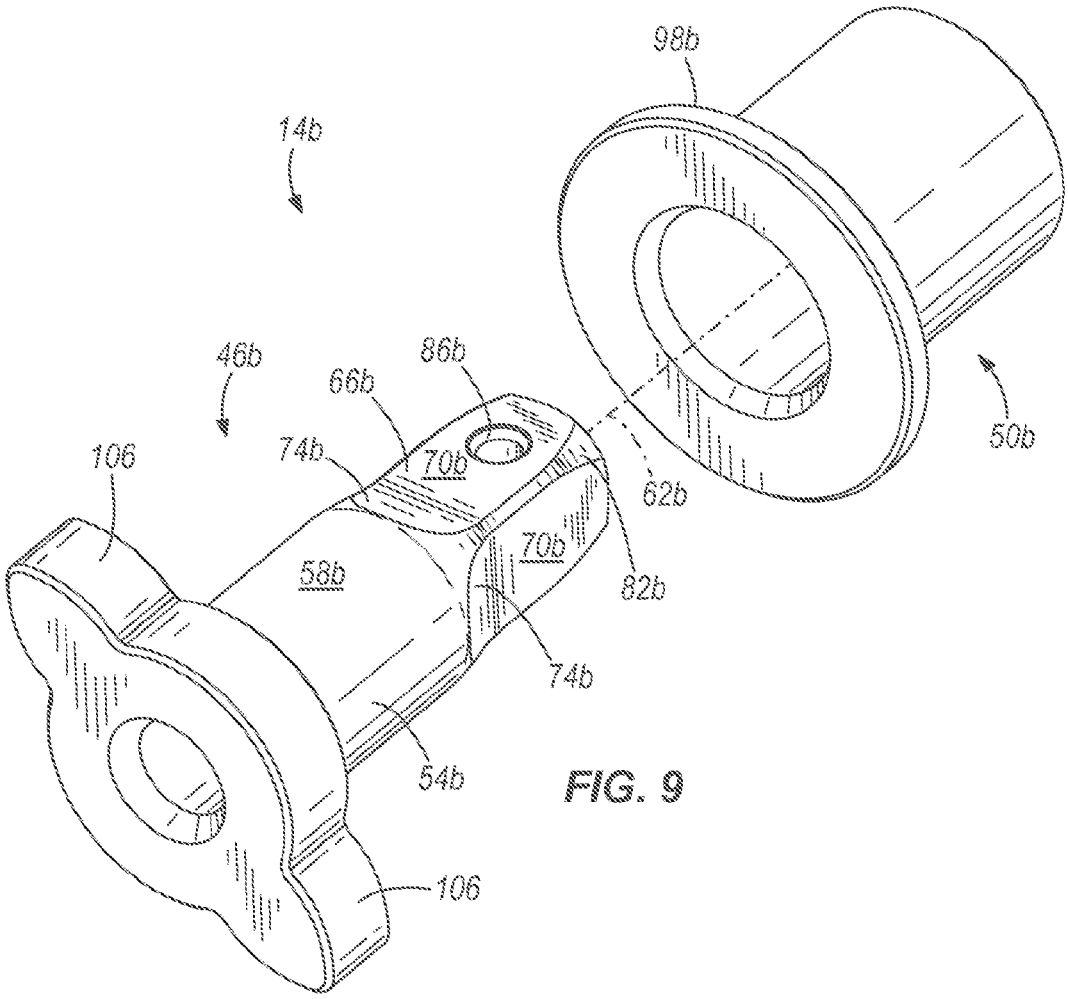
FIG. 9 is an exploded, rear perspective view of the anvil assembly of FIG. 8.
Figure 10:
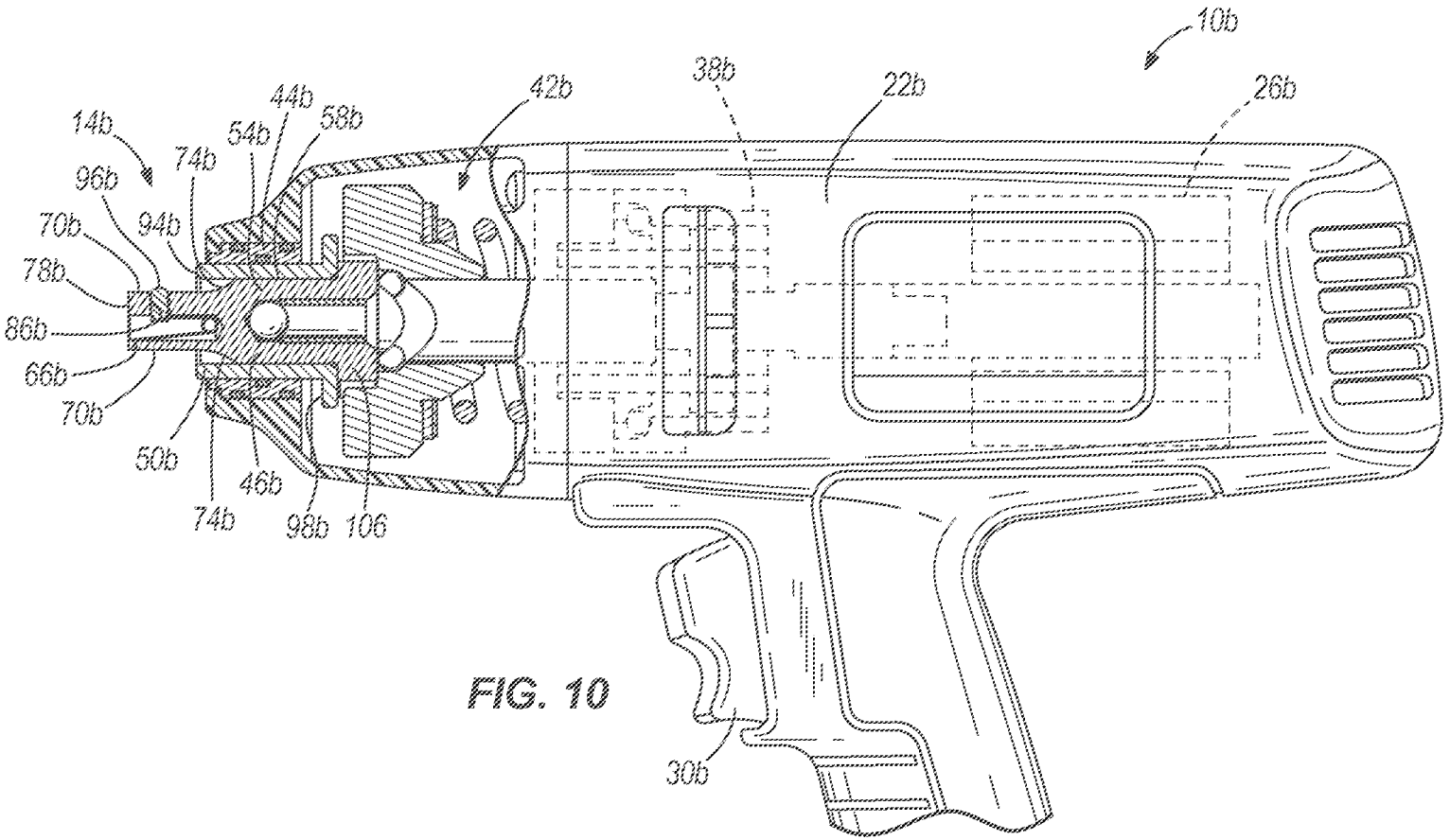
FIG. 10 is a partial cutaway view of an impact wrench incorporating the anvil assembly of FIGS. 8 and 9, and illustrating the anvil assembly in cross-section.

With reference to FIGS. 8 and 9, a third construction of the anvil assembly 14*b* is shown, with like components labeled with like reference numerals including the letter "b." The anvil assembly 14*b* is substantially similar to the anvil assembly 14 of FIGS. 1-6, however, the flange 98*b* is moved from the anvil 46*b* to the sleeve 50*b*. The rear of the flange 98*b*, in turn, is abutted against a plurality of radially-extending, driven anvil lugs 106 on the rear of the anvil 46*b*. With reference to FIG. 10, an impact wrench 10*b* incorporating the anvil assembly 14*b* is shown, with like components labeled with like reference numerals including the letter "b." The flange 98*b* is trapped between a front portion of the impact wrench housing 22*b* and the anvil lugs 106 such that axial movement of the sleeve 50*b* relative to the housing 22*b* is substantially constrained. As such, the sleeve 50*b* need not be attached to the anvil 46*b* for co-rotation (i.e., by press-fitting, welding, brazing, using adhesives, etc.), but rather may be slip-fit to the anvil 46*b* to allow the sleeve 50*b* to rotate relative to the anvil 46*b* during operation of the impact wrench 10*b*. Alternatively, the sleeve 50*b* may be fixed to the anvil 46*b* for co-rotation with the anvil 46*b* during operation of the impact wrench 10*b*.

Yet another embodiment of the anvil assembly (not shown) may omit the separate sleeve (e.g., sleeve 50 in FIG. 2), and the bushing 44 in the front of the impact wrench 10 may extend from the front of the housing 22 to position the distal end of the bushing 44 in the same location where the distal end 94 of the sleeve 50 is shown in FIG. 2. In addition to rotatably supporting the anvil 94 relative to the housing 22, the bushing 44 would also space the tool element 18 from the arcuate surfaces 74 of the anvil and accurately locate the tool element 18 relative to the detent 96. In such an alternative embodiment of the anvil assembly, the bushing 44 could be considered a sleeve.

Various features of the invention are set forth in the following claims.

What is claimed is:

1. An anvil assembly for a tool, the tool including a tool element for working on a workpiece, the anvil assembly comprising:

an anvil including a body having a cylindrical outer periphery defining a longitudinal axis, a head formed on a distal end of the body, the head including a substantially planar distal end surface, at least two substantially planar surfaces upon which the tool element is supportable, a detent aperture extending through one of the substantially planar surfaces substantially transverse to the longitudinal axis, an arcuate surface contiguous with the substantially planar surfaces and proximate the cylindrical outer periphery, a corner disposed adjacent the substantially planar surfaces, a detent element located in the detent aperture; and a sleeve surrounding at least a portion of the outer periphery of the body, the sleeve having a distal end against which the tool element is abutted when the tool element is coupled to the head;

wherein the corner, at a location on the head between the detent element and the substantially planar distal end surface, is defined by one of a radius and a taper for transferring stress surrounding the detent aperture toward the arcuate surface of the head.

2. The anvil assembly of claim 1, wherein the arcuate surface at least partially transitions the head to the outer periphery of the anvil.

3. The anvil assembly of claim 2, wherein the substantially arcuate surface is concave.

4. The anvil assembly of claim 3, wherein the arcuate surface defines a radius of at least about 0.5 inches.

5. The anvil assembly of claim 3, wherein the arcuate surface defines a radius of at least about 0.25 inches.

6. The anvil assembly of claim 1, wherein the at least two adjacent substantially planar surfaces includes four substantially planar surfaces on the head, and wherein adjacent planar surfaces on the head are disposed substantially normal to each other.

7. The anvil assembly of claim 1, wherein each of the substantially planar surfaces has a width of at least about 0.25 inches.

8. The anvil assembly of claim 1, wherein the substantially arcuate surface defines a radius that is equal to about a width of each of the substantially planar surfaces.

9. The anvil assembly of claim 1, wherein the distal end of the sleeve substantially coincides with an interface between the substantially planar surfaces and the substantially arcuate surface.

10. The anvil assembly of claim 1, wherein the corner is defined by a radius of at least about 0.5 inches.

11. The anvil assembly of claim 1, wherein the corner is defined by a radius of about two times a width of one of the substantially planar surfaces on the head.

12. The anvil assembly of claim 1, wherein the head includes a generally square cross-sectional shape in a plane substantially normal to the longitudinal axis of the anvil.

13. The anvil assembly of claim 1, wherein the sleeve is a separate and distinct component from the anvil body, and wherein the sleeve is fixed to the body for co-rotation with the body.

14. The anvil assembly of claim 1, wherein the anvil includes a flange spaced from the head, wherein the distal end of the sleeve is a first distal end, and wherein the sleeve includes a second distal end abutted against the flange.

15. The anvil assembly of claim 1, wherein the outer periphery of the body includes an end surface, wherein the distal end of the sleeve is a first distal end, and wherein the sleeve includes a second distal end abutted against the end surface.

16. The anvil assembly of claim 1, wherein the anvil includes a chamfer contiguous with at least one of the substantially planar surfaces and the corner, the chamfer transitioning the one of the substantially planar surfaces and the corner to the substantially planar end surface on the distal end of the head.

17. The anvil assembly of claim 1, wherein the anvil includes a plurality of radially-extending lugs extending from the body.

18. The anvil assembly of claim 17, wherein the sleeve includes a flange spaced from the distal end and abuts against the radially-extending lugs.

19. The anvil assembly of claim 1, wherein the corner is defined by a taper of about 11 degrees.

20. The anvil assembly of claim 1, wherein the sleeve is a separate and distinct component from the anvil body, and wherein the sleeve is able to rotate relative to the body.

* * * * *